US011965676B2

(12) United States Patent
Albri et al.

(10) Patent No.: US 11,965,676 B2
(45) Date of Patent: Apr. 23, 2024

(54) HOT-AIR FAN AND METHOD FOR OPERATING SAME

(71) Applicant: Steinel GmbH, Herzebrock-Clarholz (DE)

(72) Inventors: Frank Albri, Herzebrock-Clarholz (DE); Thomas Möller, Herford (DE); Torsten Born, Oerlinghausen (DE); Heinrich Hagemeier, Warendorf (DE); Tobias Zubke, Gütersloh (DE); Thomas Schreckenberger, Gütersloh (DE)

(73) Assignee: Steinel GmbH, Herzebrock-Clarholz (DE)

( * ) Notice: Subject to any disclaimer, the term of this patent is extended or adjusted under 35 U.S.C. 154(b) by 363 days.

(21) Appl. No.: 17/053,878

(22) PCT Filed: Dec. 18, 2019

(86) PCT No.: PCT/EP2019/086135
§ 371 (c)(1),
(2) Date: Nov. 9, 2020

(87) PCT Pub. No.: WO2020/148063
PCT Pub. Date: Jul. 23, 2020

(65) Prior Publication Data

US 2021/0372662 A1 Dec. 2, 2021

(30) Foreign Application Priority Data

Jan. 14, 2019 (DE) ..... 10 2019 100 850.6

(51) Int. Cl.
*F24H 3/04* (2022.01)

(52) U.S. Cl.
CPC ..... *F24H 3/0423* (2013.01)

(58) Field of Classification Search
None
See application file for complete search history.

(56) References Cited

U.S. PATENT DOCUMENTS 3,724,092 A * 4/1973 McCleerey ..... A45D 20/44 392/383
4,019,260 A * 4/1977 Levy ..... A45D 20/124 239/389

(Continued)

FOREIGN PATENT DOCUMENTS

CN 201896748 U 7/2011
CN 205991611 U 3/2017

(Continued)

OTHER PUBLICATIONS

Chinese notification to grant for patent application No. 201980025755.8 dated Mar. 2, 2022.

(Continued)

*Primary Examiner* — Thor S Campbell
(74) *Attorney, Agent, or Firm* — Bachman & LaPointe, P.C.

(57) ABSTRACT

The invention relates to a hot-air fan including a fan device for generating an air flow, a heating device for heating the air flow, and a control unit connected to the fan device and to the heating device. In this process, the control unit is designed to control the fan device in such a manner that, when the heating device is switched on, the fan device generates a starting air flow that is reduced to an operating air flow. The invention also relates to a method for operating the hot-air fan, including the steps of switching on the heating device and generating a starting air flow that is reduced to an operating air flow.

20 Claims, 3 Drawing Sheets

(56) References Cited

U.S. PATENT DOCUMENTS 4,097,722 A * 6/1978 Soler ..... A45D 20/122 239/455
4,232,454 A * 11/1980 Springer ..... A45D 20/122 239/455
4,511,786 A * 4/1985 Jansen ..... F24H 3/0411 392/363
4,711,988 A 12/1987 Thaler et al.
4,788,413 A * 11/1988 Eng ..... F24H 3/0423 34/554
4,939,345 A * 7/1990 Farina ..... A45D 20/10 34/97
4,977,306 A * 12/1990 Kosaka ..... A45D 20/12 34/96
4,978,896 A * 12/1990 Shah ..... F04D 27/004 318/432
5,009,592 A 4/1991 Roldan et al.
5,019,757 A * 5/1991 Beifus ..... G05D 16/2066 318/400.07
5,434,946 A * 7/1995 Barzilai ..... A45D 20/12 34/96
5,641,421 A * 6/1997 Manov ..... H05B 3/82 392/435
5,725,159 A * 3/1998 Dorber ..... A45D 20/122 239/553.3
5,841,943 A * 11/1998 Nosenchuck ..... A45D 20/10 34/97
6,038,782 A * 3/2000 Schepisi ..... A45D 20/122 392/374
6,243,532 B1 * 6/2001 Wacker ..... H02P 7/29 318/587
6,304,720 B1 * 10/2001 Richard ..... B29C 61/00 392/379
6,354,016 B1 * 3/2002 Cafaro ..... A45D 20/10 34/283
6,624,397 B2 * 9/2003 Tateishi ..... F24H 15/37 219/508
6,792,692 B1 * 9/2004 Takizawa ..... A45D 20/12 34/283
8,146,264 B1 * 4/2012 Stefano ..... A45D 20/12 392/383
9,603,430 B2 * 3/2017 Seo ..... F04D 27/00
10,046,894 B1 * 8/2018 Carter ..... F16M 11/34
10,278,471 B2 * 5/2019 Shelton ..... A45D 20/12
10,973,298 B2 * 4/2021 Kennedy ..... A45D 20/122
2005/0082277 A1 * 4/2005 Jones ..... F24F 11/80 219/494
2006/0093337 A1 * 5/2006 Chan ..... A45D 20/30 392/385
2006/0098962 A1 * 5/2006 Ceva ..... A45D 20/30 392/385
2008/0181590 A1 * 7/2008 Radwill ..... F24H 3/0423 374/E3.001
2009/0080872 A1 * 3/2009 Steinel ..... F24H 3/0423 392/379
2009/0267549 A1 * 10/2009 Kitagawa ..... H02P 23/14 318/400.14
2015/0292769 A1 * 10/2015 Einhorn ..... F24H 9/2071 392/365
2018/0172266 A1 * 6/2018 Folk ..... F24H 15/37
2020/0153364 A1 * 5/2020 Guo ..... H02P 1/04
2021/0307472 A1 * 10/2021 Conrad ..... A45D 20/50
2021/0307473 A1 * 10/2021 Conrad ..... A45D 20/50
2021/0307474 A1 * 10/2021 Conrad ..... B01D 45/16
2021/0307478 A1 * 10/2021 Conrad ..... F24H 3/0423
2023/0075030 A1 * 3/2023 Kawai ..... H02P 29/10

FOREIGN PATENT DOCUMENTS

CN 107014072 A 8/2017
CN 108800560 A 11/2018
DE 3110016 A1 9/1982
DE 68901963 T2 2/1993
DE 102005034666 A1 3/2006
DE 202011052043 U1 2/2012
EP 1956317 A2 8/2008

OTHER PUBLICATIONS

International search report for patent application No. PCT/EP2019/086135 dated Feb. 13, 2020.
Chinese office action for patent application No. 201980025755.8 dated May 7, 2021.

* cited by examiner

HOT-AIR FAN AND METHOD FOR OPERATING SAME

BACKGROUND OF THE INVENTION

The invention relates to a hot-air fan, in particular, a battery-operated handheld hot air device, as well as a method for operating same.

A hot-air fan, also called heat gun, is an electric tool with which a work space (work piece) can be purposefully heated. For this purpose, ambient air is sucked in by means of a fan device such as a fan propeller, heated by means of a heating device and then blown out to the work space through an outlet tube. By way of an example only, the following common areas of use for hot-air fans are mentioned: removing adhesive foils, heat sealing plastics, deforming plastics, removing layers of varnish or paint, especially on wood or metal, disinfecting lab equipment, drying objects.

Due to the continuous development of the battery technology, in particular, in the field of lithium-ion batteries, it is possible for the first time to also provide devices, which, on the date of filing of the application for registration, have exclusively been supplied with energy via a cable-based external power supply, as battery-operated handheld devices. Since a customary supply output in the range from 1600 watts to 2300 watts available for cable-operated hot-air fans is not possible for battery-operated handheld fans which operate on powers in the range from 600 watts to 900 watts, an efficient conversion of electrical energy into hot fan power is of essential significance for the operation of a battery-operated hot-air fan.

SUMMARY OF THE INVENTION

Accordingly, the invention is based on the object to provide a hot-air fan, in particular, a battery-operated handheld hot-air fan, as well as a method for operating same where an operating temperature of an operating air flow can be quickly achieved in an energy-efficient manner.

This object is achieved by the hot-air fan disclosed herein, as well as by the method for operating same also as disclosed herein. Advantageous embodiments and further developments of the invention are stated herein and in the subclaims.

In accordance with the invention, a hot-air fan is provided, comprising a fan device for generating an air flow, a heating device for heating the air flow, and a control unit connected to the fan device and to the heating device. In this process, the control unit is designed to control the fan device in such a manner that, when the heating device is switched on, the fan device generates a starting air flow that is reduced to an operating air flow.

Accordingly, in accordance with the invention, a battery-operated handheld hot-air fan or heat gun is provided where, on one hand, the heating device is supplied with maximum power and, on the other hand, the fan device does not generate an operating air flow immediately, i.e. an air flow which is constantly provided for the operation to be performed following a warming-up phase. Rather, when the heating device or the hot-air fan is switched on, a reduced starting air flow is initially generated by the fan device which is reduced to the operating air flow, i.e. is less with regard to its air volume or air volume flow. Thus, by heating the heating coils of the heating device in low fan operation of the fan device, an operating temperature can be quickly reached and, moreover, cooling of the heating coils associated with an increased power consumption prevented. After reaching a predetermined threshold temperature or after a predetermined period of time has expired, the fan is then switched to full operation, i.e. to the generation of an operating air flow.

To achieve preferably fast heating of the heating device due to low cooling of the heating coils of the heating device, it is convenient if the ratio of the air volumes of the starting air flow and of the operating air flow lies in a range between 10% and 90%, preferably in a range between 20% and 70%, and more preferably in a range between 30% and 60%.

During the operation of a battery-operated handheld hot-air fan, it is advantageous if the air volume of the operating air flow lies in a range between 50 l/min and 450 l/min, preferably between 100 l/min and 400 l/min, and more preferably between 200 l/min and 350 l/min.

For optimally maximum heating during the starting phase, it is advantageous if full heating power is generated at the beginning, i.e. if the control device controls the heating device in such a manner that the heating device generates a constant heating power.

For an optimum transition from the starting air flow to the operating air flow, the control device controls the fan device in such a manner that the air volume of the air flow, beginning with an air volume of the starting air flow, is incrementally increased with at least one step or gradually to an air volume of the operating air flow.

For a simple realization of the method according to the invention without the use of sensors, it is advantageous if the control device controls the fan device in such a manner that the air volume of the starting air flow is kept constant for a predetermined period of time and, after the predetermined period of time has expired, is increased to the air volume of the operating air flow.

Furthermore, the hot-air fan according to the invention can have a sensor unit connected to the control unit for measuring the temperature of the air flow downstream of the heating device and/or of the heating device.

For safe operation and to prevent overheating of the heating device, it is particularly advantageous if the control device controls the fan device in such a manner that the air volume of the starting air flow is increased to the air volume of the operating air flow dependent on the temperature measured by the sensing device.

In this process, it is particularly convenient if the control device controls the fan device in such a manner that the air volume of the starting air flow is increased to the air volume of the operating air flow when reaching a temperature threshold of the temperature measured by the sensing device.

The invention is particularly convenient for the use in hot-air fans which only have a reduced supply output. Therefore, it is advantageous if the hot-air fan has a cable-free power supply.

In particular, it is convenient if the cable-free hot-air fan is designed as a battery-operated handheld device.

For a simple realization of the fan device according to the invention, it is advantageous if the fan device comprises an electric motor and at least one fan propeller capable of being driven by means of the electric motor to generate the air flow.

Due to the energy-efficient heating method of the invention, it is advantageous if the heating device is designed to generate a constant heating output in a range between 100 W and 1500 W, preferably in a range between 200 W and 1000 W, and more preferably in a range between 600 W and 900 W.

For a simple start of operation of the hot-air fan, it is convenient if the hot-air fan further includes an operating switch for switching the hot-air fan on and off, in particular, at least the heating device, the fan device and the control unit.

Furthermore, in accordance with the invention, a method for operating the hot-air fan according to the invention is provided where at first the heating device is switched on, whereupon, instead of generating a customary maximum operating air flow, a starting air flow that is reduced to an operating air flow is generated.

BRIEF DESCRIPTION OF THE DRAWINGS

Further advantages, features and details of the invention emerge from the following description of preferred exemplary embodiments, as well as on the basis of the drawings, in which.

Identical components and components with the same function are marked with the same reference numeral in the figures.

DETAILED DESCRIPTION

Figure 1:
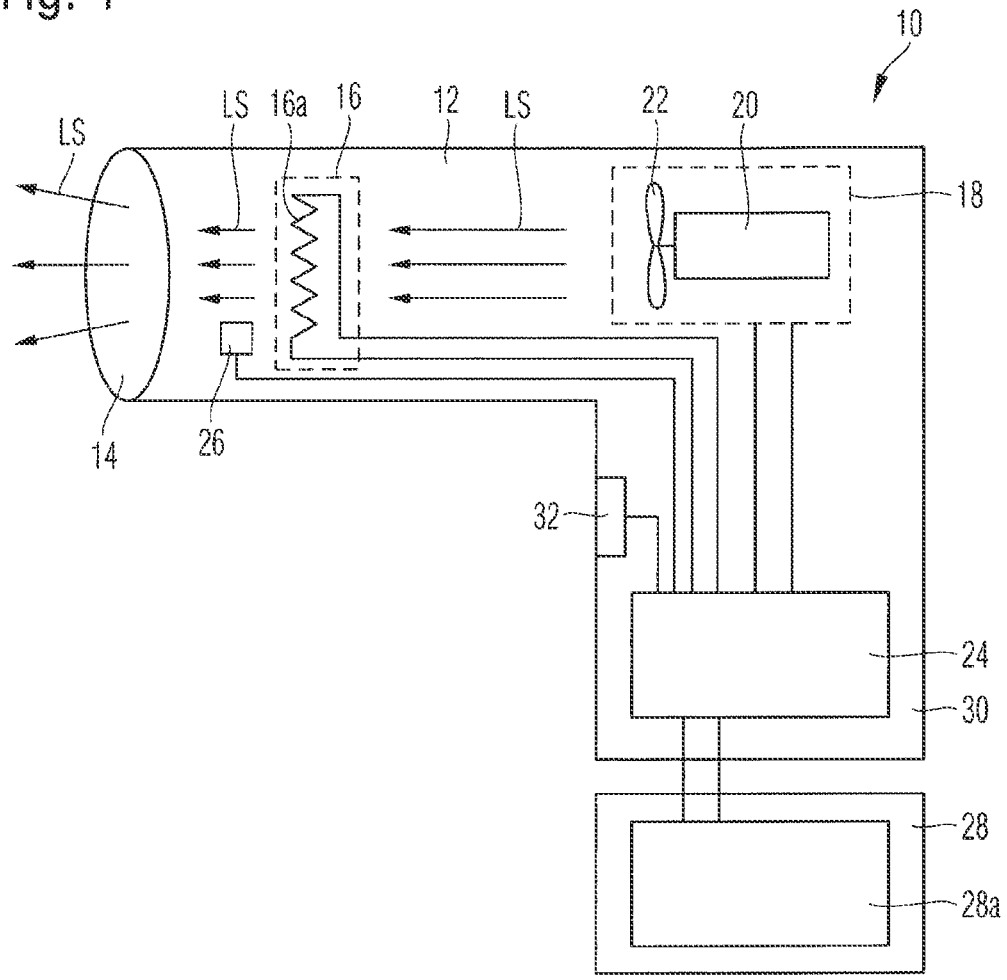
FIG. 1: shows a highly schematic representation of a hot-air fan according to the invention designed as a battery-operated handheld device.

FIG. 1 shows a highly simplified schematic chart of a hot-air fan 10 according to the invention.

The hot-air fan 10 illustrated in FIG. 1 has an elongated housing 12 on which, on one end, an air outlet 14 for heated air is provided. This heated air is generated by an (otherwise known) heating device 16, through which air is sucked in through an air inlet (not shown) by means of a fan device 18 and, heated to an operating temperature of up to ca. 500° C., can exit through the air outlet 14. In this process, the operating temperature is between 400 and 500° C.

To generate the air flow, the fan device 18 has an electric motor 20 and at least one fan propeller 22 capable of being driven by means of the electric motor 20. The electric motor 20 of the fan device 18 is designed as a brush motor.

To heat the air flow LS, the heating device 16 has at least one heating coil 16*a*. In this process, the heating coil 16*a* can, for example, be made of a nickel-chrome wire. The heating device 16 is designed to generate a constant heating output in a range between 100 W and 1500 W, preferably in a range between 200 W and 1000 W, and more preferably in a range between 600 W and 900 W.

A schematically shown control unit 24 effects both a temperature control (for example, to a settable target value) with the aid of a sensor unit 26 designed as a temperature sensor which is provided on the side of the outlet, as well as an appropriate control of the heating device 16 or fan device 18. In this process, the control unit 24 can control and monitor a hot-air fan operation with different work stages. For example, the control unit 24 can operate the hot-air fan 10 with at least two different heating powers or corresponding air flow temperatures of the air flow LS.

The electrical energy supply of the hot-air fan 10 is effected via a battery module 28, which can be mounted or clicked into place on the bottom side of a gun-shaped handle section 30 of the hot-air fan 10 in a known manner. The battery module 28 has an electric energy storage 28*a* which is preferably designed as an electric battery.

In this process, a lithium-ion battery can be provided as the electric battery 28*a*, which can be set to an operating voltage of 36V or 18V. By providing the battery module 28 as the power supply, a hot-air fan output of the hot-air fan 10 according to the invention can be provided in the range of, for example, 600 W or 900 W.

Thus, the hot-air fan 10 has a cable-free power supply according to the exemplary embodiment shown in FIG. 1. The cable-free hot-air fan 10 can be designed as a battery-operated handheld device. However, the invention is not to be restricted to the operation of a battery-operated hot-air fan, but can be used everywhere where energy-efficient and fast achievement of the operating temperature is convenient.

The hot-air fan 10 can further include an operating switch 32, through which the hot-air fan 10, in particular, at least the heating device 16, the fan device and the control unit 24 can be switched on or off. To that end, the operating switch 32, the fan device 18, the heating device 16 and the sensor unit 26 are electrically connected to the control unit 24 in such a manner that electric signals from the control unit 24 are transferred to the devices 16, 18 and/or the devices 16, 18 are supplied with electric power by the control unit 24.

Furthermore, the control unit 24 receives a switch on/off signal, through which switching on of the heating device 16 can be initiated, from the operating switch 32. Furthermore, the control unit 24 is electrically connected to the sensor unit 26 to either receive a measurement signal or only measure a measuring current by the sensor unit 26 (for example, when using a Pt100 temperature sensor element).

As also shown in FIG. 1, the hot-air fan 10 according to the invention comprises the fan device 18 for generating an air flow LS which exits through the heating device 16 at the air outlet 14 after heating. The control unit 24 is electrically connected to the fan device 18 and to the heating device 16.

In the following text, the function according to the invention as well as the corresponding method of operation of the hot-air fan 10 is to be explained.

Object of the invention is to generate as quickly as possible an operating temperature of the air flow LS in an energy-efficient manner, i.e. in a particularly convenient manner when using a battery-operated hot-air fan, although only a low heating power compared to cable-operated hot-air fans is available. In accordance with the invention, this object is achieved in that, when the heating device 16 is switched on, the fan device 18 is controlled by the control unit 24 in such a manner that the fan device 18 generates a starting air flow that is reduced to an operating air flow as an air flow LS.

An air flow LS is to be defined as an operating air flow which is generated in the continuous operation mode by the fan device 18 during a normal operation mode of the hot-air fan 10. Thus, the operating air flow differs from the starting air flow in that it is constantly generated by the fan device 18 following a warming-up phase of the hot-air fan 10, whereas the starting air flow is to be understood as an air flow LS which is generated by the fan device 18 directly after the heating device 16 has been switched on.

Since the fan device 18 does not generate a maximum operating air flow immediately after switching on the heating device 16, but a reduced starting air flow, the heating device 16 or the heating coil 16*a* of the heating device 16 can be heated faster as there is lower or reduced cooling by the starting air flow (compared to cooling by a stronger operating air flow).

Figure 2:
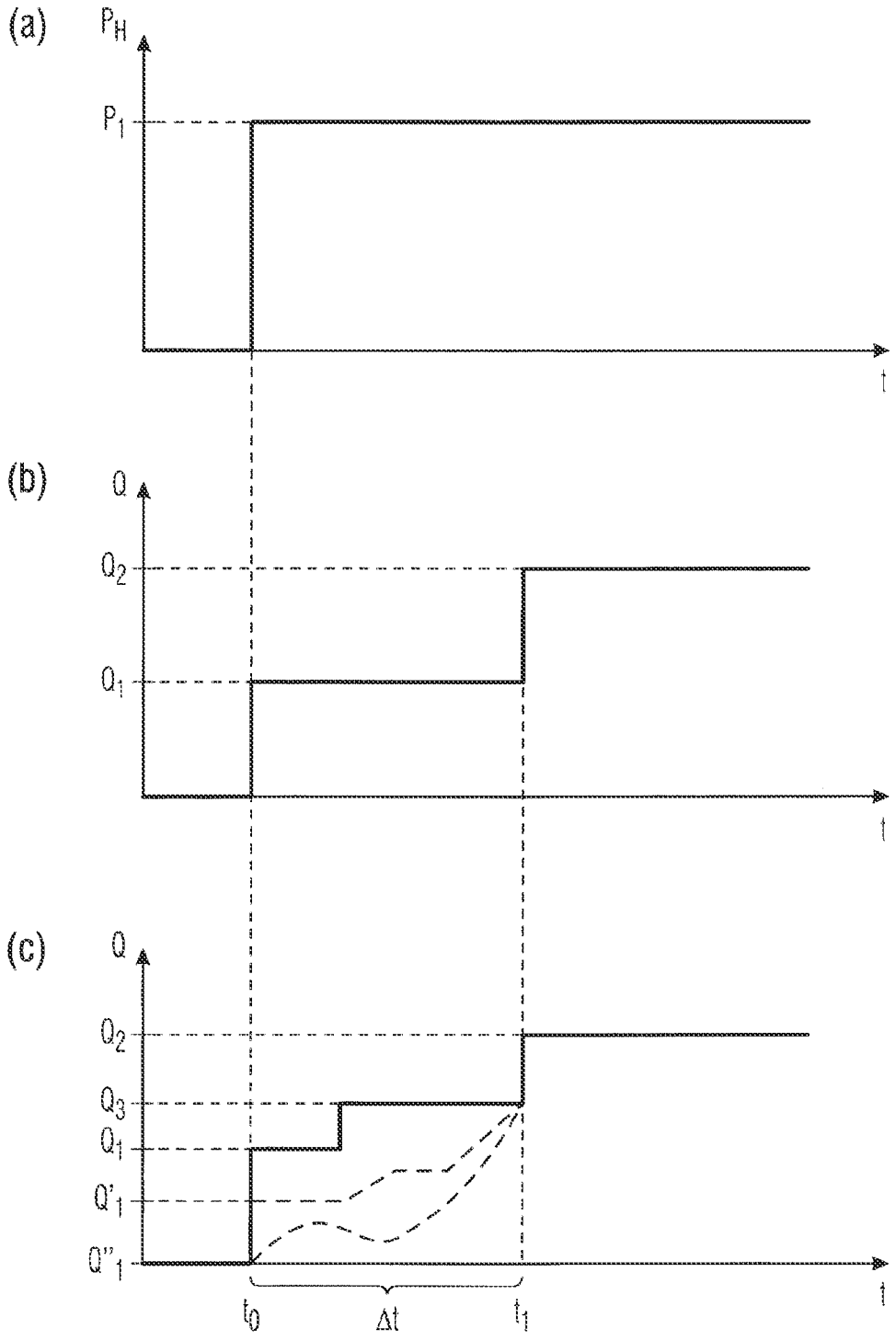
FIG. 2: shows a representation of a chronological sequence of the heating output generated by the heating device, as well as of the air volume or volume flow of the air flow generated by the fan device in the operation of the hot-air fan according to a first exemplary embodiment of the invention.

FIG. 2 schematically illustrates a chronological sequence of the heating output PH of the heating device 16 and of the air volumes Q of the air flow LS of the fan device 18.

As can be seen from FIG. 2(*a*), the heating output PH is immediately switched to the full heating power P1 of the heating device 16 by the control unit 24 at a point in time t0, i.e. when switching on the heating device 16.

In contrast (see FIG. 2(*b*)), the control unit 24 controls the fan device 18, when switching on the heating device 16, in such a manner that it does not immediately generate an operating air flow with the air volume or the volume flow Q2 at the point in time t0, but initially a starting air flow with the air volume or the volume flow Q1. Thus, the control device 24 controls the heating device 16 in such a manner that the heating device 16 generates a constant heating output PH immediately after switching on the heating device 16.

As can further be seen from FIG. 2(*b*), the control device 24, after the heating device 16 or the hot-air fan 10 has been switched on, controls the fan device 18 in such a manner that the air volume Q of the air flow LS, beginning with an air volume Q1 of the starting air flow, is incrementally increased with at least one step or gradually to an air volume Q2 of the operating air flow.

As can be seen from FIG. 2(*c*), the transition between the starting air flow Q1 and the operating air flow Q2 can also be performed by several steps. In this process, an air volume Q3 is set as an intermediate air flow prior to the incremental transition from Q1 to Q2. In addition, it is conceivable that the transition is not only incremental, but is gradually increased, with a constant increase or by means of an arbitrary constant characteristic curve, from a starting air flow with the air volume Q1 to an operating air flow with the air volume Q2. In addition, it is also possible that a mix of incremental increase and gradual increase is generated by the fan device 18, as shown by the dashed characteristic curves in FIG. 2(*c*). In this process, it is also possible that the starting air flow Q"1 is at zero and is then increased from the point in time t0.

Thus, as can be seen from FIG. 2(*b*), the ratio of the air volumes Q1/Q2 of the starting air flow and of the operating air flow can be about 50%. However, it is also possible that the ratio of the air volumes Q1/Q2 of the starting air flow and of the operating air flow lies in a range between 0% and 90%, in a range between 10% and 90%, preferably in a range between 20% and 70%, and more preferably in a range between 30% and 60%.

With regard to the absolute values of the air volume, the air volume Q1 of the starting air flow of the fan device 18 can lie in a range between 0 l/min and 400 l/min, in a range between 10 l/min and 400 l/min, preferably between 20 l/min and 300 l/min, between 20 l/min and 200 l/min, between 50 l/min and 200 l/min, and more preferably between 50 l/min and 150 l/min. With regard to the absolute values of the air volume, the air volume Q2 of the operating air flow of the fan device 18 can lie in a range between 50 l/min and 450 l/min, preferably between 100 l/min and 400 l/min, and more preferably between 200 l/min and 350 l/min.

In the exemplary embodiment shown in FIG. 2, the fan device 18 can be controlled by the control unit 24 in such a manner that the air volume Q1 of the starting air flow is kept constant for a predetermined period of time Δt from the point in time t0 of switching on the heating device 16 and, after the predetermined period of time Δt has expired, is increased to the air volume Q2 of the operating air flow at the point in time t1. Thus, there is no control of the fan device, but mere switching of the air flow from the starting air flow Q1 to the operating air flow Q2 after a predetermined period of time Δt has expired, which can be determined by means of a simple timing element in the control unit 24. In this process, the predetermined period of time Δt can lie in a range between 1 s and 150 s, between 5 s and 100 s, between 5 s and 40 s, and especially in a range between 5 s and 25 s.

Figure 3:
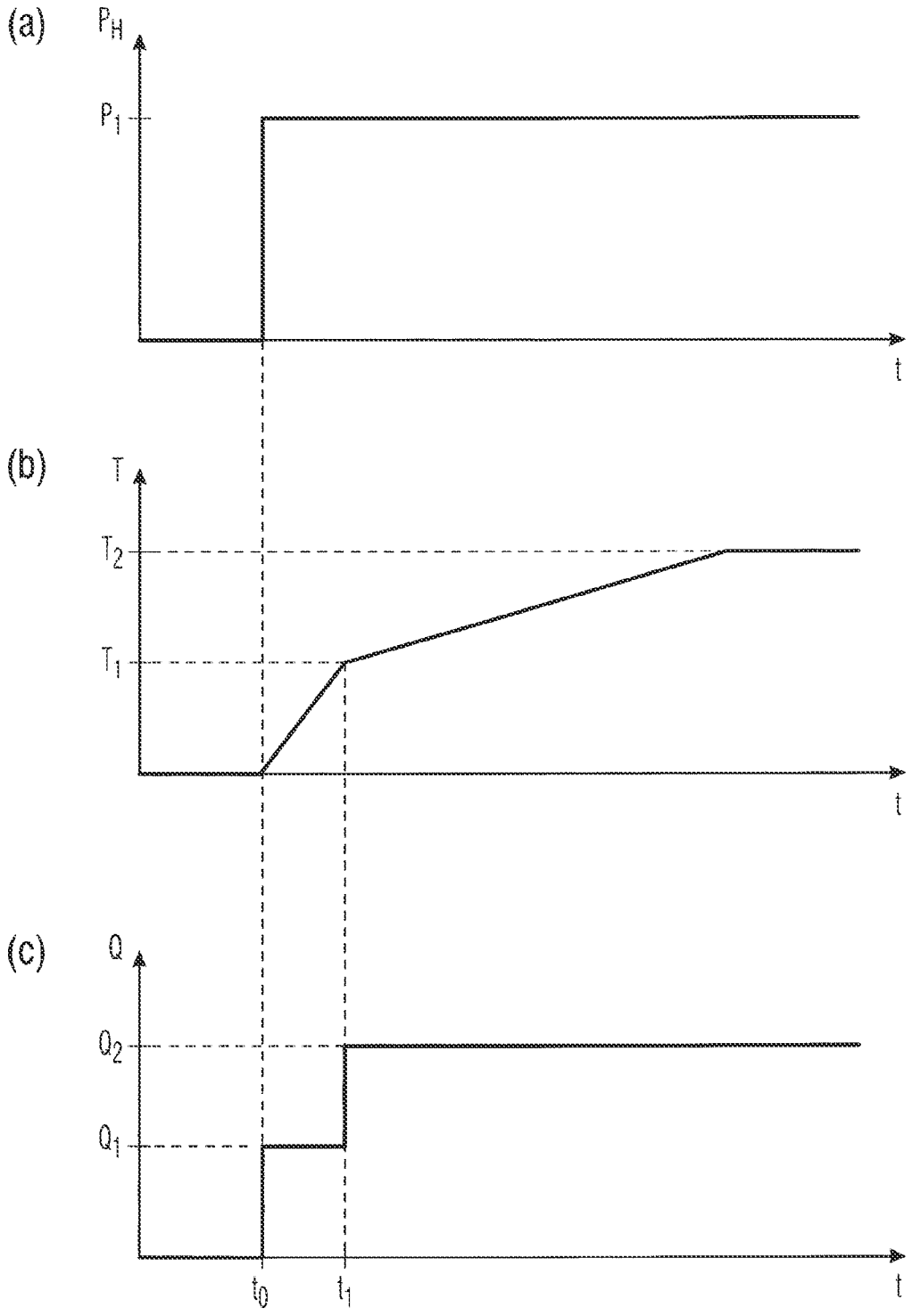
FIG. 3: shows a representation of a chronological sequence of the heating output generated by the heating device, of the temperature of the heating device, as well as of the air volume or volume flow of the air flow generated by the fan device in the operation according to a second exemplary embodiment of the invention.

FIG. 3 shows a method of operation according to the second exemplary embodiment of the invention.

According to the second exemplary embodiment of the invention, the control unit 24 controls the fan device 18 in such a manner that the air volume Q1 of the starting air flow is increased to the air volume Q2 of the operating air flow dependent on the temperature T measured by the sensing device 26.

To that end, the sensor unit 26 can measure either the temperature of the air flow downstream of the heating device 16 and/or the temperature of the heating device 16 itself. For this purpose, a temperature sensor can, for example, be provided on a ceramic housing of the heating device 16, which is located close to the heating coils 16*a* of the heating device 16. What temperature is measured by the sensor unit 26 is of secondary importance for the method according to the invention and function. However, at this point it should be mentioned that, for example, the temperature of the heating coils 16*a* themselves could be determined based on their temperature-dependent resistance.

As shown in FIG. 3(*a*), the heating output PH of the heating device 16 is set to full power P1 after the heating device 16 has been switched on. Due to the reduced starting air flow Q1 (see FIG. 3(*c*)) during a starting phase or warming-up phase of the operation of the hot-air fan 10, temperature T of the heating device 16 measured by the sensor unit 26 increases quickly, as shown in FIG. 3(*b*).

When reaching a threshold temperature T1, the control unit 24 controls the fan device 18 in such a manner that it incrementally switches from a starting air flow Q1 to an operating air flow Q2. From the point of changeover t1, the temperature T of the heating device 16 increases less quickly due to the increased fan power and asymtotically turns into the operating temperature T2. In this process, the threshold temperature T1 can lie in a range between 100 degree Celcius and 600 degree Celcius, in a range between 100 degree Celcius and 500 degree Celcius, in a range between 200 degree Celcius and 400 degree Celcius, or in a range between 250 degree Celcius and 350 degree Celcius. In this process, the operating temperature T2 can lie in a range between 200 degree Celcius and 700 degree Celcius, in a range between 300 degree Celcius and 700 degree Celcius, in a range between 400 degree Celcius and 700 degree Celcius, or in a range between 500 degree Celcius and 600 degree Celcius.

Thus, an operating temperature T2 is quickly achieved by the method according to the invention, with an energy-efficient start of the hot-air fan 10 being achieved at the same time. The reason for this is that the power consumption of the hot-air fan 10 is, due to the lack of full cooling power, reduced by the fan device 18 and completely introduced into the heating of the heating device 16. As a positive side effect, also the operability is increased since the operating temperature is reached faster for the commencement of an operation.

The present invention is not restricted to the exemplary embodiments or operation modes shown, rather, numerous additional and alternative configuration options and choices offer themselves.

The invention claimed is:

1. A handheld hot air device (10), comprising a fan device (18) for generating an air flow (LS), a heating device (16) for heating the air flow (LS), and a control unit (24) connected to the fan device (18) and to the heating device (16) which is designed to control the fan device in such a manner that, when the heating device (16) is switched on, the fan device (18) generates a starting air flow that is reduced in comparison to an operating air flow, and wherein the control device (24) controls the fan device (18) in such a manner that the air volume (Q1) of the starting air flow is kept constant for a predetermined period of time (Δt) and, after the predetermined period of time (Δt) has expired, is increased to the air volume (Q2) of the operating air flow.

2. The handheld hot air device (10) according to claim 1, wherein the ratio of the air volumes (Q1/Q2) of the starting air flow and of the operating air flow lies in a range between 10% and 90%.

3. The handheld hot air device (10) according to claim 1, wherein the air volume (Q2) of the operating air flow lies in a range between 50 l/min and 450 l/min.

4. The handheld hot air device (10) according to claim 1, wherein the control device (24) controls the heating device (16) in such a manner that the heating device (16) generates a constant heating power (P1).

5. The handheld hot air device (10) according to claim 1, wherein the control device (24) controls the fan device (18) in such a manner that the air volume (Q) of the air flow (LS), beginning with an air volume (Q1) of the starting air flow, is incrementally increased with at least one step or gradually to an air volume (Q2) of the operating air flow.

6. The handheld hot air device (10) according to claim 1, further comprising a sensor unit (26) connected to the control unit (24) for measuring the temperature (T) of the air flow (LS) downstream of the heating device (16) and/or of the heating device (16).

7. The handheld hot air device (10) according to claim 1, wherein the handheld hot air device (10) has a cable-free power supply.

8. The handheld hot air device (10) according to claim 7, wherein the cable-free handheld hot air device (10) is designed as a battery-operated handheld device or as a heat gun.

9. The handheld hot air device (10) (10) according to claim 1, wherein the fan device (18) comprises an electric motor (20) and at least one fan propeller (22) capable of being driven by means of the electric motor (20) for generating the air flow (LS).

10. The handheld hot air device (10) according to claim 1, wherein the heating device (16) is designed to generate a constant heating output (PH) in a range between 100 W and 1500 W.

11. The handheld hot air device (10) according to claim 1, further comprising an operating switch (32) for switching on at least the heating device (16), the fan device (18) and the control unit (24).

12. The handheld hot air device (10) according to claim 2, wherein the ratio lies in a range between 20% and 70%.

13. The handheld hot air device (10) according to claim 2, wherein the ratio is in a range between 30% and 60%.

14. The handheld hot air device (10) according to claim 3, wherein the air volume (Q2) of the operating air flow lies in a range between 100 l/min and 400 l/min.

15. The handheld hot air device (10) according to claim 3, wherein the air volume (Q2) of the operating air flow lies in a range between 200 l/min and 350 l/min.

16. The handheld hot air device (10) according to claim 10, wherein the heating device (16) is designed to generate a constant heating output (PH) in a range between 200 W and 1000 W.

17. The handheld hot air device (10) according to claim 10, wherein the heating device (16) is designed to generate a constant heating output (PH) in a range between 600 W and 900 W.

18. A method for operating a handheld hot air device (10) according to claim 1, comprising the steps of switching on the heating device (16), and generating a starting air flow that is reduced to an operating air flow.

19. A handheld hot air device (10), comprising a fan device (18) for generating an air flow (LS), a heating device (16) for heating the air flow (LS), and a control unit (24) connected to the fan device (18) and to the heating device (16) which is designed to control the fan device in such a manner that, when the heating device (16) is switched on, the fan device (18) generates a starting air flow that is reduced in comparison to an operating air flow, and a sensor unit (26) connected to the control unit (24) for measuring the temperature (T) of the air flow (LS) downstream of the heating device (16) and/or of the heating device (16), wherein the control unit (24) controls the fan device (18) in such a manner that the air volume (Q1) of the starting air flow is increased to the air volume (Q2) of the operating air flow dependent on the temperature (T) measured by the sensing device (26).

20. The handheld hot air device (10) according to claim 19, wherein the control device (24) controls the fan device (18) in such a manner that the air volume (Q1) of the starting air flow is increased to the air volume (Q2) of the operating air flow when reaching a temperature threshold (T1) of the temperature (T) measured by the sensing device (26).

* * * * *